US006250985B1

(12) United States Patent
Nicholson

(10) Patent No.: US 6,250,985 B1
(45) Date of Patent: Jun. 26, 2001

(54) HOLLOW BREAKABLE OBJECT HAVING A BREAKABLE DYE ABSORPTIVE COATING

(76) Inventor: Joseph A. Nicholson, 1676 Spring Valley Rd., Dade City, FL (US) 33523

( * ) Notice: Subject to any disclaimer, the term of this patent is extended or adjusted under 35 U.S.C. 154(b) by 0 days.

(21) Appl. No.: 09/490,016

(22) Filed: Jan. 21, 2000

Related U.S. Application Data

(63) Continuation-in-part of application No. 09/017,510, filed on Feb. 2, 1998, now abandoned.

(51) Int. Cl.[7] ..... A63H 33/04; A63H 33/00; A63H 3/00

(52) U.S. Cl. ..... 446/76; 446/5; 446/368; 446/491

(58) Field of Search ..... 446/4, 5, 71, 72, 446/73, 76, 79, 368, 491; 426/104

(56) References Cited

U.S. PATENT DOCUMENTS

| | | | | |
|---|---|---|---|---|
| 294,575 | * | 3/1884 | Britton | 426/104 |
| 1,383,290 | * | 7/1921 | Cressey | 426/104 |
| 1,931,409 | * | 10/1933 | Humphrey | 426/104 |
| 3,005,284 | * | 10/1961 | Guiliano | 446/5 |
| 3,961,089 | * | 6/1976 | Dogliotti | 426/104 X |
| 3,983,658 | | 10/1976 | de Sanz . | |
| 4,736,943 | | 4/1988 | Fukuda et al. . | |
| 4,817,936 | | 4/1989 | Matsuda . | |
| 4,964,831 | | 10/1990 | Wolff . | |
| 5,098,327 | | 3/1992 | Ferrero . | |
| 5,209,345 | | 5/1993 | Haugabook . | |
| 5,332,605 | | 7/1994 | DeLamar . | |
| 5,405,148 | * | 4/1995 | Cianci | 446/368 X |
| 5,545,069 | * | 8/1996 | Glynn et al. | 446/73 |
| 5,603,993 | | 2/1997 | Ampomah . | |
| 5,655,944 | | 8/1997 | Fusselman . | |
| 5,658,603 | | 8/1997 | Anderson et al. . | |
| 5,743,404 | | 4/1998 | Melashenko et al. . | |
| 5,792,496 | * | 8/1998 | Fekete et al. | 426/104 |
| 5,795,209 | * | 8/1998 | Moore | 446/73 |
| 5,813,895 | * | 9/1998 | Cho | 446/368 |
| 5,925,391 | * | 7/1999 | Whetstone, Jr. | 426/104 X |
| 5,961,363 | * | 10/1999 | Spector | 446/73 X |

* cited by examiner

*Primary Examiner*—D. Neal Muir
(74) *Attorney, Agent, or Firm*—Sutherland Asbill & Brennan LLP

(57) ABSTRACT

A hollow breakable object having a first shell section and a second shell section encapsulating a novelty item when the shell sections are affixed to each other. The sections are typically affixed by press-fitting, gluing, or taping the sections together. When the sections are affixed, they form a hollow shell, typically in an egg shape, having an enclosed internal chamber. The hollow shell may also have a scoring providing a convenient predefined break point on the object. Affixed to or incorporated as part of the interior of each section is an internal support structure to provide padding support to the novelty item. A coating is applied to the exterior of the affixed sections to form a breakable and dye absorptive surface of the object. The coating is made of either gypsum, limestone, silicate or a combination thereof and is advantageously capable of absorbing conventional egg dye. Additionally, the object is biodegradable.

29 Claims, 2 Drawing Sheets

HOLLOW BREAKABLE OBJECT HAVING A BREAKABLE DYE ABSORPTIVE COATING

CROSS-REFERENCE TO RELATED APPLICATIONS

This application is a continuation-in-part of U.S. patent application Ser. No. 09/017,510, filed Feb. 2, 1998, now abandoned.

TECHNICAL FIELD

The present invention relates to novelty items, and more particularly, relates to a hollow biodegradable object containing a novelty item wherein the object has a breakable coating capable of absorbing conventional egg dye.

BACKGROUND OF THE INVENTION

For many people, Easter is generally a happy time of year. During this time of year, people typically celebrate Easter by dying eggs in a wonderful variety of colors. However, conventional egg dyes are known to penetrate the shell of the dyed egg and contaminate the interior of the shell and the egg therein. Additionally, dyed eggs have a short and discrete shelf-life before rotting begins to occur. Many organizations, such as churches, have moved away from using dyed natural eggs due to the associated contamination and rotting problems. Dyed natural eggs placed in a grass yard that are not found during an egg hunting game are eventually found much later due to their foul aroma. In essence, this kind of contamination and rotting can quickly turn a happy Easter into a sad occasion.

To solve the contamination and rotting problem, many people now use artificial eggs or, more particularly stated, plastic eggs. It is well known in the art to make artificial eggs from plastic in a wide variety of colors. These artificial eggs may be separable so that a premium or novelty item, such as candy or a toy, may be placed inside. However, such plastic eggs cannot be dyed with conventional egg dyes, such as Easter egg dyes produced and distributed by Durkee French Foods of Wayne, N.J. Essentially, the fun of dying Easter eggs is lost when a celebrant is forced to use such conventional plastic eggs.

There are a variety of patents that describe hollow breakable objects, similar to eggs, capable of containing a premium or novelty item. For example, U.S. Pat. No. 5,332,605 entitled "Hollow Decorative Object Containing Novelties" and invented by DeLamar discloses a hollow decorative object, in the general shape of an egg with a flat base region, containing inside one or more novelty items. The hollow decorative object is made from unfired pottery clay. In this manner, the outer shell of the hollow decorative object is sufficiently hard and shape retaining for normal handling but is still capable of being cut open with a knife. In other words, by only hardening the material without firing it, an opening may be cut into the hollow decorative object through which the novelty items can be removed without otherwise breaking or damaging the hollow decorative object. However, such a hollow decorative object is not coated so that it can be dyed with conventional egg dyes. Furthermore, such a hollow decorative object is not biodegradable.

Additionally, U.S. Pat. No. 3,983,658 entitled, "Pinatas" and invented by de Sanz describes two equal spherical halves making a hollow body. Toys and candy are typically inserted within the two halves as novelty items. The halves are glued together with adhesive. The halves are made of extruded polystyrene, which is strong, light, and frangible.

While remaining breakable like a natural egg, such a hollow body made of extruded polystyrene is not capable of being dyed like a natural egg using conventional egg dyes. Furthermore, the hollow body of extruded polystyrene is not biodegradable.

In summary, there is a need for a breakable hollow object in the shape of an egg which contains a premium or novelty item, prevents contamination of the interior of the object, prevents spoilage of the premium or novelty item, and is dyeable with conventional egg dye similar to a natural egg.

SUMMARY OF THE PRESENT INVENTION

The present invention generally provides a hollow breakable object capable of containing inside thereof a novelty item. The hollow breakable object is capable of being cracked open like a natural egg and absorbing conventional egg dye. Stated generally, the hollow breakable object of the present invention includes a hollow shell and a coating. The hollow shell is typically biodegradable while the coating may be broken down into component parts, such as inert and naturally occurring elements. The hollow shell is capable of being broken apart and is usually made from a biodegradable fibrous material, such as paper mache or molded pulp, in the general shape of an egg. The coating encases the hollow shell and is generally made from either gypsum, limestone, or silicate or a combination of the materials.

The coating may include a scoring along the surface of the coating. The scoring provides a predefined break point for the hollow breakable object. In this manner, an abrupt force applied to the predefined break point can easily break the coating and the hollow shell to permit access to the novelty item.

More particularly described, the present invention is a hollow breakable object capable of containing a novelty item. The hollow breakable object includes a first shell section and a second shell section. When the shell sections are affixed to each other, they form a hollow shell, typically in the general shape of an egg, having an enclosed internal chamber. The novelty item is contained within this enclosed internal chamber. A coating encases the shell sections. The coating is breakable and capable of absorbing conventional egg dye. Desirably, the coating is hard, smooth and brittle so as to crack and break like a natural egg. Typically, the coating is made of a material having the components of gypsum, limestone, silicate, or a combination thereof.

Additionally, the first shell section and the second shell section are each biodegradable. The present invention typically achieves such biodegradability by making the first shell section and the second shell section out of a biodegradable fibrous material. The biodegradable fibrous material may be molded pulp, molded fiber or paper mache as well as other biodegradable materials.

Furthermore, each of the sections have an internal support structure capable of providing padding support to the novelty item within the enclosed internal chamber. The internal support structures help to prevent damage to the novelty item.

Additionally, the first section may have a scoring. The scoring provides a predefined break point for the first shell section. Typically, the scoring is located on the first shell section or on both the first shell section and the second shell section. In this manner, the object can be easily broken open along the scoring to allow access to 10 the enclosed interior chamber and the novelty item.

Although the preferred embodiment of the present invention is directed towards an egg shaped breakable object having a coating capable of absorbing conventional egg dyes, it should be understood that the present invention may be applied to a broad variety of hollow breakable objects.

In summary, it is an object of the present invention to provide a hollow breakable object capable of absorbing conventional egg dye.

It is a further object of the present invention to provide a biodegradable object, shaped like an egg, that is capable of containing a novelty item.

It is a further object of the present invention to provide an object having a breakable coating that easily absorbs convention egg dye without contaminating the enclosed interior chamber of the object.

It is a further object of the present invention to provide a hollow breakable object capable of absorbing convention egg dye without having spoilage problems.

It is a further object of the present invention to provide a hollow breakable object capable of providing padding support to a novelty item enclosed within the object.

It is a further object of the present invention to provide a hollow breakable object capable of being broken into easily to access the enclosed novelty item.

The present invention and its advantages, those described above and otherwise, will be appreciated from studying the following detailed description and drawings, and the appended claims.

DETAILED DESCRIPTION OF THE PREFERRED EMBODIMENT

An embodiment of the present invention is a breakable hollow object, such as a hollow artificial egg, for containing novelty items where the object comprises a pair of shell sections fit that together in the shape of an egg. The shell sections are then coated with a continuous, frangible (breakable) dye absorptive coating that seals the shell sections together so that the object may advantageously be dyed with conventional egg dye without the egg dye contaminating the interior of the shell.

The shell sections are typically made of biodegradable material, such as paper mache or molded pulp. The coating is made of a material that, while it may be dye absorptive, remains capable of being broken down into its naturally occurring components, similar to a natural egg shell.

Figure 1:
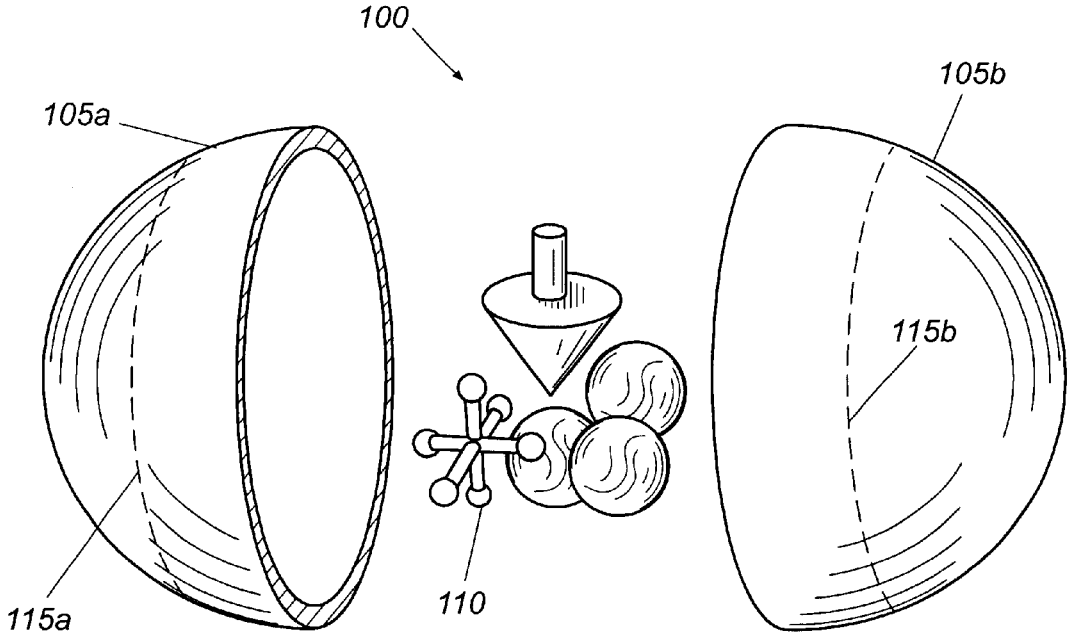
FIG. 1 is a perspective illustration of two shell sections of a hollow breakable object capable of containing a novelty item.

Referring now to FIG. 1, the object 100 is typically made from two shell sections 105*a*, 105*b*. The shell sections 105*a*, 105*b* together are in the shape of an oblong, spheroidal body, preferably in the shape of an egg. The shell sections 105*a*, 105*b* form a hollow shell when affixed to each other and typically enclose a novelty item 110, such as a toy or candy. In this manner, the shell sections 105*a*, 105*b* encapsulate the novelty item 110 when affixed to form the hollow shell.

The shell sections 105*a*, 105*b* are generally made of a biodegradable fibrous material. Examples of such biodegradable material include, but are not limited to cardboard, paper mache, molded pulp or molded fiber, pressed peat, or wood. Preferably, the shell sections 105*a*, 105*b* are made of molded pulp or molded fiber.

Molded pulp means depositing fibers from a pulp slurry onto a perforated mold. In the case of the present invention, the mold may be in the shape of an egg shell section. After depositing the slurry onto the mold, either pressure is applied to the slurry or a vacuum is applied behind the mold to cause the fibers to become more dense. The preform is then dried with or without heat.

Molded pulp or molded fiber is desirable for use in the present invention because these materials form a unique substrate which acts like a membrane in a natural egg. When a coating is applied to the to the object, it clings to this unique substrate as a shell clings to the membrane in a natural egg. Accordingly, cracking the object open is very similar to cracking open a real egg. Molded pulp and molded fiber are also advantageous because they can be molded into complex shapes.

Each of the shell sections 105*a*, 105*b* may also have a scoring 115*a*, 115*b*, which helps to break open the object 100 once assembled. The scoring 15*a*, 115*b* is defined as a marking, groove or other type of shallow indentation such as a notch on the interior surface but preferably on the exterior surface of the shell sections 105*a*, 105*b*. The scoring does not penetrate or puncture the shell surface until force is applied to break the object open. The scoring 115*a*, 115*b* can be a single notch or it may be a continuous notch around the particular shell section 105*a*, 105*b*. The scoring 115*a*, 115*b* on a shell section operates to weaken the particular point on the shell section in order to make it easier to break open the object 100 at a predefined break point. Essentially, the predefined break point is along the location of the scoring 115*a*, 115*b*.

In the preferred embodiment of the present invention, the scoring 115*a* on a shell section 105*a* is a notch on the shell section 105*a*, preferably a continuous notch circumscribing the shell section 105*a*. In this manner, the object 100 may be broken open along the scorings 115*a*, 115*b* typically by applying an abrupt force along one of the particular scorings 105*a*, 105*b*. For example, if the object 100 is shaped like an artificial egg, the artificial egg is treated like a natural egg in that it can be dyed and cracked or broken open just like a natural egg. However, the artificial egg of the present invention does not spoil like a natural egg. Furthermore, the artificial egg also contains an undamaged novelty item 110 while having the capacity of being dyed and broken open like natural eggs.

Once the shell sections 105*a*, 105*b* encapsulate the novelty item 110, the material of the shell sections 105*a*, 105*b* provides padding support to the enclosed novelty item 110. In this manner, damage to the novelty item 110 can be avoided or at least minimized. The affixation of the shell sections 105*a*, 105*b* and the structure for providing padding support is described in more detail in FIGS. 2A, 2B, and 2C.

Figure 2A:
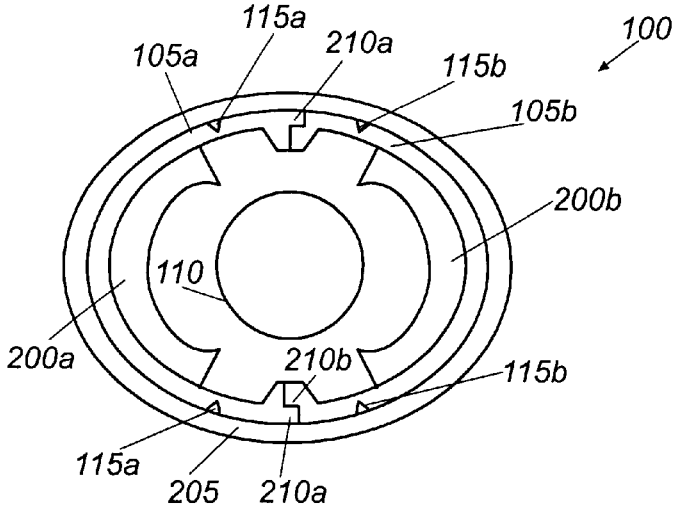
FIGS. 2A, 2B, and 2C are diagrams of a cross section of a hollow breakable object illustrating shell sections, the intersection of the shell sections, internal support structures supporting a novelty item, and a coating encompassing the affixed shell sections in accordance with three embodiments of the present invention.
Figure 2B:
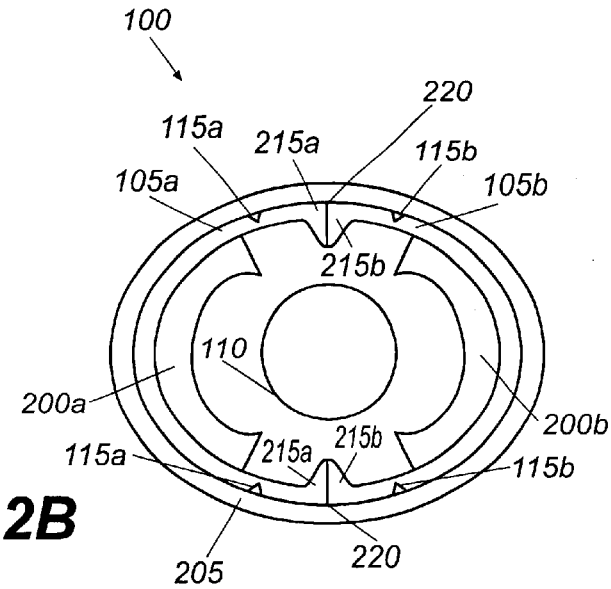
Figure 2C:
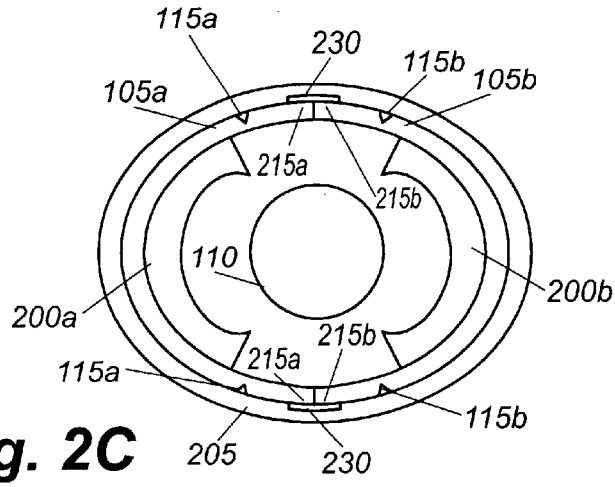

A coating is applied to the shell sections 105*a*, 105*b* once the shell sections 105*a*, 105*b* are affixed to each other. FIGS. 2A, 2B, and 2C illustrate a cross-section view of three different embodiments of the object 100 once the coating has been applied.

Referring now to FIG. 2A, a coating 205 encases the affixed shell sections 105*a*, 105*b*. The coating 205 is a key component of the present invention because it seals the object 100 while allowing the object 100 to remain breakable. Furthermore, the coating 205 is dye absorptive so that the object 100 can be dyed with conventional egg dye. In this manner, the object 100 can be effectively treated as a natural egg without the contamination and spoilage problems that come with using dyed natural eggs.

In the preferred embodiment, a suitable coating 205 is made from a material or composition that includes gypsum, limestone, silicate, or a combination of these materials. Essentially, these materials help to make the coating 205 absorptive of dyes. However, the present invention is not limited to these materials or combination of materials.

In an exemplary embodiment of the present invention, the coating 205 may be made of a main ingredient, such as limestone, a material chiefly made of calcium carbonate ($CaCO_3$). Instead of limestone, the main ingredient of the coating 205 may also be gypsum ($CaSO_4 2H_2O$), marble (chiefly $CaCO_3$), chalk (a soft $CaCO_3$ with varying amounts of silica, quartz, feldspar, or other impurities), whiting (a white grade of chalk), or dolomite ($CaMg(CO_3)_2$) or some other dye absorptive material. These materials are commercially available from manufacturers such as Florida Tile Corporation located in Lakeland, Fla.

Other ingredients are typically added to the main ingredient of the coating to provide fluidity for application and binding characteristics for adhesion. For example, a typical coating 205 may include types of clay called ball clay and bentonite. Those familiar with minerals and clay will appreciate that ball clay is basically a mix of very fine grained plate-like particles (generally sub-micron in size) with small amounts of fine mineral particles and organic matter. Typically, ball clay is largely made of hydrous aluminum silicates (kaolinite) with other clay minerals and, sometimes, finely-sized minerals and organic materials. When mixed with water, ball clay becomes very pliable and easy to form. When the water is removed, ball clay will dry to a hard mass (hence acting as a bonding agent). Ball clay is commercially available under the brand name "Old Mine No. 4" from Kentucky-Tennessee Clay Company of Mayfield, Ky.

Bentonite, another type of clay, is principally an aluminum silicate clay containing magnesium and iron and is distinguished by its sodium or calcium content with corresponding high or low swelling capacity. Bentonite is commercially available from Wyoming Bentonite located in Cheyenne, Wyo. In an embodiment of the present invention, ball clay and bentonite are useful for providing binding characteristics to the coating 205 so that the coating 205 adheres to the shell sections 105*a*, 105*b*.

Additionally, the coating 205 typically includes water (liquid $H_2O$) and may also include liquid sodium silicate. The water provides a liquid medium with which to apply the coating 205. The liquid sodium silicate acts as a glue or bonding agent. Sodium silicate in either a liquefied or crystallized form is available from Oxidental Chemical, Dallas, Tex.

In summary, the present invention merely requires that the coating 205 be made of a material that becomes hard, smooth, and brittle so as to be frangible when dried and is absorptive of conventional egg dye. Examples of such a material may include hydraulic cements, reaction cements, and precipitation cements. Hydraulic cements include, but are not limited to portland cement, calcium aluminum cement, natural lime-silica cement, barium silicate cement, barium aluminate cement, slag cements and ferrite cements. Reaction cements include, but are not limited to, monoaluminum phosphate and magnesium or zirconium oxychloride cements. Precipitation cements include, but are not limited to, sodium silicatetypes of cement using salt or ester additives and ethyl orthosilicate with acid or base additives. When using such cements, no other bonding agents typically need to be added to the coating material.

In an exemplary embodiment, typical combinations of the components that make up the coating 205 may include the 5 combinations as set forth below in Table 1.

TABLE 1

| Coating | Sample Coating | | | | |
|---|---|---|---|---|---|
| Component | #1 | #2 | #3 | #4 | #5 |
| Main Ingredient | 100 grams | 100 grams | 100 grams | 100 grams | 100 grams |
| Ball Clay | 5 grams | 3–5 grams | — | — | 1–3 grams |
| Bentonite | — | .5–2 grams | .5–3 grams | .5–3 grams | .5–1 gram |
| Liquid Sodium Silicate | — | — | — | 1–3 grams | 1–2 grams |
| Liquid $H_2O$ | 25–60 ml | 25–60 ml | 25–60 ml | 25–60 ml | 25–60 ml |

Each of the sample coatings (#1–#5) listed in Table 1 use the main ingredient (preferably ground and pulverized into a powder), a bonding agent (such as one of both types of clay), and some water. Sample coatings #4 and #5 also use a small amount of liquid sodium silicate as a bonding agent or adhesive allowing the coating to adhere to the shell.

A coating 205 is generally prepared by finely milling or mixing the coating components to insure uniform dispersion of the micron-sized particles within the coating material so that no clumping of the particles occurs. Each of the components are added to the water, preferably by adding the components having the least amount into the water first. The consistency of the coating 205 may be varied by adding additional amounts of water to the other components until a desired consistency is reached.

For dipping applications, the consistency of the coating 205 is desired to be such that when the shell sections 105*a*, 105*b* are dipped into the liquefied coating 205, the thickness of the coating remaining on the sections 105*a*, 105*b* is approximately one-sixteenth of an inch. In the preferred embodiment, when dipping the shell sections 105*a*, 105*b*, the material may include electrolytes (such as a mixture of sodium carbonate, potassium carbonate, or nitrite) in small amounts to adjust the "set" or "pick up" characteristics of the slurry of material used for a dip-applied coating. For spraying applications, a more fluid consistency is generally desired, depending upon the precise spraying apparatus used to apply the liquefied coating 105 to the shell sections 105*a*, 105*b*.

Thus, the coating 205 is typically applied by spraying or dipping the shell sections 105*a*, 105*b* (once affixed together as the hollow shell) with the above described material in a liquid form. During the application process, the material adheres to the surface of the affixed shell sections 105*a*, 105*b* (the hollow shell).

Typically, once coated, the shell sections 105*a*, 105*b* and the coating 205 are left to dry. In the preferred embodiment, the shell sections 105*a*, 105*b* and the coating 205 are preferably dried at 100 degrees Centigrade with humidity controlled so that no cracking occurs in the coating 205 as water is gradually removed. In this manner, the material dries to form the continuous coating 205 encasing the affixed shell sections 105*a*, 105*b* (the hollow shell). Desirably, the coating 205 completely encapsulates both shell sections 105*a*, 105*b* so that the coating is continuous about the entire object like the shell of a natural egg.

While it is preferable to apply the coating material by spraying or dipping, the present invention contemplates using any type of conventional manufacturing process capable of depositing the coating material on the exterior of the shell sections 105*a*, 105*b* to form the coating 205. For example, the present invention contemplates that the coating 205 may be applied by various known vapor deposition techniques. In large volume manufacturing situations, the present invention further contemplates applying the coating 205 via electrostatic spraying. Basically, electrostatic spraying electrically charges the particles making up the coating materials before being applied to a oppositely charged substrate, such as the shell sections.

Furthermore, the coating application process may be repeated depending upon the adhesion qualities of the coating material on the shell sections 105*a*, 105*b* and the desired thickness of the coating 205. When the coating application process is complete, the dried coating 205 is dyeable and breakable.

Additionally, internal support structures 200*a*, 200*b* are illustrated in FIG. 2A on each of the shell sections 105*a*, 105*b*. As previously mentioned, the material of shell sections 105*a*, 105*b* provides padding support to the enclosed novelty item 110. In this manner, damage to the novelty item 110 can be avoided or at least minimized. The internal support structures 200*a*, 200*b* enhance the protection of the novelty item 110 and are located within the enclosed internal chamber defined by the shell sections 105*a*, 105*b*.

In one embodiment, the internal support structures 200*a*, 200*b* are affixed respectively to the shell sections 105*a*, 105*b*. In this embodiment, the internal support structures 200*a*, 200*b* are made of padding type of material, such as paper, cardboard, paper mache, or molded pulp or molded fiber. In the preferred embodiment, the material of the internal support structures 200*a*, 200*b* is also biodegradable.

In a preferred embodiment, the internal support structures 200*a*, 200*b* are integrated or incorporated as part of the respective shell sections 105*a*, 105*b* in order to enhance the padding support. The interior of each shell section 105*a*, 105*b* is formed to provide this additional padding support. In this manner, the support structures would be made of the same material as the shell sections 105*a*, 105*b*.

It is important to understand that the shape of the internal support structures 200*a*, 200*b* is generally not critical as long as the internal support structures 200*a*, 200*b* provide padding support to the novelty item 110. The present invention also contemplates using internal support structures 200*a*, 200*b* (whether integrated as part of the shell sections 105*a*, 105*b* or not) that are conformally shaped to accept the novelty item 110. This is particularly useful when the novelty item 110 is a relatively heavy item capable of causing damage or even breaking the coating 205 if the novelty item 110 is not substantially immobilized. In this embodiment, the novelty item 110 is substantially immobilized when it is placed in between the conformaly shaped internal support structures 200*a*, 200*b* within the shell sections 105*a*, 105*b*.

There are several different implementations of how the shell sections 105*a*, 105*b* can be affixed to each other before being encased with the coating 205. In one implementation, shown in FIG. 2A, the shell sections 105*a*, 105*b* are affixed to one another in a press-fit or snap attachment configuration. In particular, the edge 210*a* of one shell section 105*a* has an exterior oriented configuration while the edge 210*b* of the other shell section 105*b* has an interior oriented configuration. When the two shell sections 105*a*, 105*b* are pressed together, the edge 210*b* with the interior orientation fits into the edge 210*a* having the exterior orientation. The edges 210*a*, 210*b* stay affixed due either to friction forces from the press-fit or due to a conventional snap-fit attachment whereby each edge 210*a*, 210*b* is configured to grip the other edge once the two shell sections 105*a*, 105*b* are pressed together. Once the shell sections 105*a*, 105*b* are affixed, the coating 205 may be applied.

Another embodiment of how the shell sections 105*a*, 105*b* are affixed to each other is illustrated is FIG. 2B. Referring now to FIG. 2B, the shell sections 105*a*, 105*b* are affixed to each other by applying an adhesive (such as Elmer's® Glue manufactured by Elmer's Products, Inc. of Columbus, Ohio) to the respective edges 215*a*, 215*b* of the shell sections 105*a*, 105*b*. In this embodiment, the shell sections 105*a*, 105*b* have similar edges 215*a*, 215*b*. There is a contact area 220 at the intersection of the respective edges 215*a*, 215*b*. Although the size of the contact area 220 is not crucial to the present invention, the contact area 220 is preferably wider than the width of each shell section 105*a*, 105*b* to facilitate an adequate bond between the shell sections 105*a*, 105*b*.

Adhesive is applied to the edges 215*a*, 215*b* of the shell sections 105*a*, 105*b* before the shell sections 105*a*, 105*b* are pressed together. Once pressed together, the adhesive along the contact area 220 (also known as the intersection of the shell sections) bonds the shell sections 105*a*, 105*b* to form the hollow shell.

To aid in the proper alignment of the shell sections 105*a*, 105*b*, the edges 215*a*, 215*b* may also include alignment guides (not shown). An example of such alignment guides includes, but is not limited to, a post on one edge 215*a* and an alignment hole on the other edge 215*b*. The use of such alignment guides facilitates proper alignment of the shell sections 105*a*, 105*b* when affixing the two shell sections 105*a*, 105*b* together with the adhesive. Preferably, the alignment guides are integral parts of the shell sections 105*a*, 105*b* along the edges 215*a*, 215*b* and, thus, are also biodegradable.

Yet another embodiment of how the shell sections 105*a*, 105*b* are affixed to each other is illustrated in FIG. 2C. Referring now to FIG. 2C, the shell sections 105*a*, 105*b* are affixed to each other by applying tape 230 along the intersection of the respective edges 215*a*, 215*b* of the shell sections 105*a*, 105*b*. The tape 230 is preferably an adhesive tape made of paper or some other biodegradable material. The tape 230 is applied once the shell sections 105*a*, 105*b* are aligned properly and pressed together.

The main function of the tape 230 is merely to hold the shell sections 105*a*, 105*b* together adequately while the coating 205 is applied to encase the shell sections 105*a*, 105*b* as discussed in detail above. It is not required that the tape 230 circumscribe the entire intersection of the shell sections 105*a*, 105*b*. However, the tape 230 may also circumscribe the shell sections 105*a*, 105*b* to seal the two shell sections 105*a*, 105*b*. Sealing the shell sections 105*a*, 105*b* prevents the coating material from seeping within the internal enclosed chamber defined within the shell sections 105*a*, 105*b*.

Similar to the adhesive attachment configuration illustrated in FIG. 2B, the tape attachment configuration illustrated in FIG. 2C may include alignment guides to assist proper alignment during the process of applying the tape 230.

At this stage, the novelty item 110 has been placed within the shell sections 105*a*, 105*b* and the shell sections 105*a*, 105*b* have been affixed to each other before the coating 205 has been applied. The scoring 115*a*, 115*b* beneath the coating 205 on the shell sections 105*a*, 105*b* provides a convenient break point for breaking or opening the object 100 in order to gain access to its interior.

Additionally, another type of scoring (not shown) may be applied to the exterior of the coating 205 to provide another convenient break point for breaking or opening the object 100. This may prove advantageous if the thickness of the coating 205 or the material of the coating 205 makes it difficult to easily crack or break the coating 205.

Figure 3:
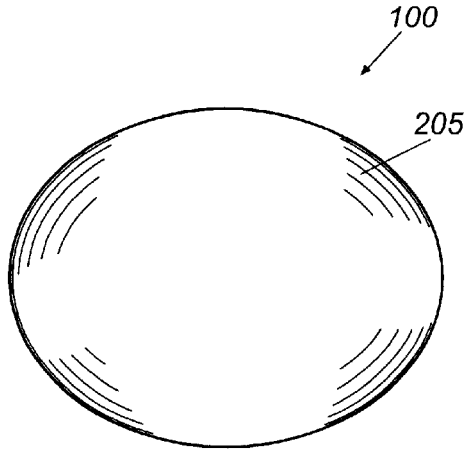
FIG. 3 is an illustration of the exterior of a hollow breakable object.

FIG. 3 is an illustration of the coated object of the present invention. Referring now to FIG. 3, an exterior view of the hollow breakable object 100 is illustrated after the coating 205 has been completely applied. Once the coating 230 has been applied to the shell sections 105*a*, 105*b*, the object 100 is ready to be dyed with conventional egg dyes. For example, the conventional egg dyes from the Durkee-French Foods Company of Wayne, N.J. are typically made of water, propylene glycol, artificial colors, propylparaben and sodium metabisulphite (as a preservative). The material of the coating 230 is advantageously capable of accepting and absorbing such conventional egg dyes while remaining breakable like the shell of a natural egg.

In view of the foregoing description of the preferred embodiment, it will be appreciated that the present invention overcomes the drawbacks of prior solutions of the problems presented to the inventor and meets the objects of the invention as described above. Alternative embodiments will become apparent to those skilled in the art to which the present invention pertains without departing from its spirit and scope. Accordingly, the scope of the present invention is defined by the appended claims rather than the foregoing description.

What is claimed is:

1. A hollow breakable object containing inside thereof a novelty item, the hollow breakable object comprising:

a hollow shell capable of being broken apart; wherein the shell has a scoring along the surface of the shell, the scoring providing a predefined break point for the hollow breakable object; and a coating encasing the hollow shell, the coating being breakable and capable of absorbing conventional egg dye.

2. The hollow breakable object of claim 1, wherein the hollow shell is biodegradable.

3. The hollow breakable object of claim 2, wherein the hollow shell is made from a biodegradable fibrous material in the general shape of an egg.

4. The hollow breakable object of claim 3, wherein the biodegradable fibrous material is molded pulp.

5. The hollow breakable object of claim 1, wherein the coating includes a material selected from the group consisting of gypsum, limestone, and silicate.

6. The hollow breakable object of claim 1, wherein the coating comprises gypsum, limestone and calcium silicate.

7. The hollow breakable object of claim 1, wherein the coating is hard, smooth and brittle.

8. The hollow breakable object of claim 1, wherein the hollow breakable object further comprises:

a first shell section;

a second shell section, which when affixed to the first shell section the first and second shell sections forming a hollow shell having an enclosed internal chamber containing the novelty item.

9. The hollow breakable object of claim 8, wherein the first shell section and the second shell section are biodegradable.

10. The hollow breakable object of claim 9, wherein:

the first shell section and the second shell section are made of a biodegradable fibrous material;

the first shell section and the second shell section each have an internal support structure capable of providing padding support to the novelty item within the enclosed internal chamber to prevent damage to the novelty item; and the first shell section and the second shell section together form the general shape of an egg.

11. The hollow breakable object of claim 10, wherein the biodegradable fibrous material is molded pulp.

12. The hollow breakable object of claim 10, wherein the biodegradable fibrous material is paper mache.

13. The hollow breakable object of claim 8, wherein the coating includes a material selected from the group consisting of gypsum limestone and silicate.

14. The hollow breakable object of claim 8, wherein the coating comprises gypsum, limestone and calcium silicate.

15. The hollow breakable object of claim 8, wherein at least one shell section has the scoring, the scoring providing a predefined break point for breaking into the enclosed internal chamber of the hollow breakable object.

16. The hollow breakable object of claim 15, wherein the scoring is located proximate to an intersection of the first shell section and the second shell section.

17. A hollow breakable object containing inside thereof a novelty item, the hollow breakable object comprising;

a first shell section made of a biodegradable fibrous material and having a scoring circumscribing the first shell section to provide a predetermined break point for the first shell section;

a first internal support structure incorporated into the interior of the first shell section, the first internal support structure providing padding support to the novelty item;

a second shell section made of the biodegradable fibrous material, the second shell section affixed to the first shell section to form a hollow shell having an enclosed internal chamber in which the novelty item is disposed;

a second internal support structure incorporated into the interior of the second shell section, the second internal support structure providing further padding support to the novelty item; and a coating applied to the exterior of the first shell section and the exterior of the second shell section, the coating being breakable and capable of absorbing conventional egg dye, and the coating further including a material selected from the group consisting of gypsum, limestone, and silicate.

18. The hollow breakable object of claim 17, wherein the coating comprises gypsum, limestone, and calcium silicate.

19. The hollow breakable object of claim 17, wherein the scoring is located proximate to an intersection of the first shell section and the second shell section.

20. The hollow breakable object of claim 17, wherein the biodegradable fibrous material is molded pulp.

21. A hollow breakable object containing inside thereof a novelty item, the hollow breakable object comprising:

a hollow shell capable of being broken apart, wherein the hollow shell is made of molded pulp; and a coating encasing the hollow shell, the coating being breakable and capable of absorbing conventional egg dye.

22. The hollow breakable object of claim 21, wherein the hollow shell is made in the general shape of an egg.

23. The hollow breakable object of claim 21, wherein the coating comprises gypsum, limestone and calcium silicate.

24. The hollow breakable object of claim 21, wherein the hollow shell has a scoring along the surface of the hollow shell, the scoring providing a predefined break point for the hollow breakable object.

25. The hollow breakable object of claim 21, wherein the coating is hard, smooth and brittle.

26. The hollow breakable object of claim 21, wherein the hollow breakable object further comprises:

a first shell section;

a second shell section, which when affixed to the first shell section the first and second shell sections forming a hollow shell having an enclosed internal chamber containing the novelty item.

27. The hollow breakable object of claim 26, wherein:

the first shell section and the second shell section each have an internal support structure capable of providing padding support to the novelty item within the enclosed internal chamber to prevent damage to the novelty item; and the first shell section and the second shell section together form the general shape of an egg.

28. The hollow breakable object of claim 26, wherein at least one shell section has a scoring circumscribing said shell section, the scoring providing a predefined break point for breaking into the enclosed internal chamber of the hollow breakable object.

29. The hollow breakable object of claim 28, wherein the scoring is located proximate to an intersection of the first shell section and the second shell section.

* * * * *